US006619003B2

(12) United States Patent
Von Arx et al.

(10) Patent No.: US 6,619,003 B2
(45) Date of Patent: Sep. 16, 2003

(54) METHOD OF ASSEMBLING A FRAME ASSEMBLY FOR A PARTITION SYSTEM

(75) Inventors: John Paul Von Arx, Rice Lake, WI (US); Charles Joseph Librande, Cameron, WI (US)

(73) Assignee: Quanex Corporation, Houston, TX (US)

( * ) Notice: Subject to any disclaimer, the term of this patent is extended or adjusted under 35 U.S.C. 154(b) by 0 days.

(21) Appl. No.: 10/055,519

(22) Filed: Jan. 23, 2002

(65) Prior Publication Data

US 2003/0136064 A1 Jul. 24, 2003

(51) Int. Cl.[7] ..... E04B 1/00; E04B 2/00

(52) U.S. Cl. ..... 52/222; 29/469; 29/509; 29/897.32; 29/897; 135/119; 135/907; 135/913; 52/36.11; 52/144; 52/208; 52/222; 52/273; 52/238.1; 52/239; 52/281.1; 52/455; 52/458; 52/479; 52/656.1; 52/656.9; 52/716.1; 52/718.01; 52/800.1; 52/800.11; 160/135; 160/239; 160/240; 160/268.1; 160/327; 160/328; 160/351; 160/368.1; 160/371; 160/378; 160/380; 160/383; 160/391; 160/394; 160/400; 160/403; 38/102.1; 38/102.3; 38/102.4; 38/102.91; 101/127.1

(58) Field of Search ..... 52/363.1, 222, 52/203, 144, 273, 455–458, 479, 481.2, 620, 624, 238.1, 239, 240, 281, 282.1, 656.1, 656.9, 657, 716.1, 718.01, 745.06, 745.09, 783.1, 787.1, 787.11, 800.1, 800.11, 806; 160/135, 239, 240, 266, 268.1, 269, 327, 328, 351, 368.1, 371, 378, 380, 381, 382, 383, 391, 394, 400, 403; 38/102.1, 102.3, 102.4, 102.91; 24/530, 543, 559; 135/119, 907, 913; 101/127, 127.1; 29/897.32, 897.3, 897, 428, 429

(56) References Cited

U.S. PATENT DOCUMENTS

| | | | |
|---|---|---|---|
| 3,058,279 | A | 10/1962 | Metcalfe |
| 3,751,771 | A | 8/1973 | Vipond |
| 3,950,869 | A | 4/1976 | Samarin |
| 4,676,016 | A | 6/1987 | Phillips et al. |
| 4,817,699 | A | 4/1989 | Fein |
| 5,230,377 | A | 7/1993 | Berman |
| 4,676,016 | A | 9/1995 | Phillips et al. |
| 5,839,240 | A | 11/1998 | Elsholz et al. |
| 6,132,666 | A | 10/2000 | Foley et al. |

OTHER PUBLICATIONS

Co–pending "Frame Assembly and Frame Component for Tensioning Fabric About a Panel of a Partition System" Ser. No. (to be assigned).

*Primary Examiner*—Carl D. Friedman
*Assistant Examiner*—Christy Green
(74) *Attorney, Agent, or Firm*—Howard & Howard

(57) ABSTRACT

A method of assembling a frame assembly for a partition system is disclosed. The frame assembly includes a partition panel, a fabric covering the panel, and a frame component. The frame component automatically and evenly tensions the fabric about the panel. The frame component provided according to this method includes a support element, a lockable element, and an integral hinge defined between the support and lockable elements. The support element defines a cavity for receiving and supporting the panel. The lockable element extends from and is moveable relative to the support element. The panel is inserted into the cavity, and the fabric is mounted to the lockable element. Next, the lockable element is moved about the integral hinge such that the fabric mounted to the lockable element is automatically and evenly tensioned about the panel. A backing strip may be mounted to the frame component to protect the fabric from the integral hinge.

27 Claims, 5 Drawing Sheets

METHOD OF ASSEMBLING A FRAME ASSEMBLY FOR A PARTITION SYSTEM

RELATED APPLICATIONS

The subject application is related to commonly-assigned United States patent application entitled "Frame Assembly Ad Frame Component Fr Tensioning Fabric About A Panel Of A Partition System" which was filed on the same day as the subject application.

BACKGROUND OF THE INVENTION

1. Technical Field

The subject invention generally relates to a method of assembling a frame assembly for a partition, or cubicle, system for dividing office space, building space, and the like. More specifically, the subject invention relates to a method of assembling a frame assembly that provides a frame component of the frame assembly and utilizes this frame component to automatically and evenly tension a fabric about a partition panel of the frame assembly.

2. Description of the Related Art

Partition systems and methods of assembling frame assemblies for the partition systems are known in the art. Partition systems are primarily made up of a plurality of partition panels that are interconnected upon installation of the partition system. The frame assemblies for use in the partition systems may also include frame components to border, or frame, the partition panels. The partition panels of the partition systems are utilized to divide office space between co-workers and others to enhance privacy and to improve work efficiency. Partition systems are becoming increasingly popular for various reasons. For instance, installation of a partition system requires a relatively low capital investment as compared to the capital investment required to construct permanent walls for division of office space. Furthermore, partition systems are dynamic. That is, partition systems can be quickly and inexpensively reconfigured to reallocate office space. A example of a conventional partition system is disclosed in U.S. Pat. No. 5,839,240 to Elsholz et al.

To enhance the overall appearance of the partition systems, a 'show surface' of the partition panels is covered by a fabric. For the fabric to appear acceptable on the partition panels, it must be appropriately tensioned about the partition panels. In the partition systems of the prior art, the show surface of the partition panel is covered and the fabric is tensioned about the partition panels by a process of manually stretching, i.e., tensioning, the fabric about the partition panel. As understood by those skilled in the art, this manual stretching process is labor-intensive, time-consuming, expensive, and otherwise cumbersome. Furthermore, because this manual stretching process is inconsistent, the process frequently does not achieve appropriate tension on the fabric. Ultimately, unacceptable ripples and sags are visible in the fabric covering the partition panel. The partition systems and the methods of assembling the frame assemblies for these partition systems do not utilize the frame components that frame the partition panels to eliminate this manual stretching process.

It is noteworthy that, in other industries, systems other than partition systems have previously attempted to utilize a frame component to address some of the aforementioned deficiencies. For example, in U.S. Pat. No. 3,950,869 to Samarin, a frame component for stretching an artist's fabric, such as canvas and the like, is disclosed. The frame component disclosed in the '869 patent to Samarin is particularly deficient in that it is not unitary. Furthermore, this frame component does not define a cavity to effectively receive and support partition panels that are to be inserted into the frame component for a partition system. In U.S. Pat. No. 5,230,377 to Berman, a border piece, i.e., a frame component, for mounting an upholstered wall fabric is disclosed. Like the '869 patent to Samarin, the frame component disclosed in the '377 patent to Berman is deficient because it does not define a cavity to effectively receive and support partition panels that are to be inserted into the frame component for a partition system. Finally, in U.S. Pat. No. 3,751,771 to Vipond, a frame component for securing a fabric to upholstered furniture is disclosed. The frame component disclosed in the '771 patent to Vipond is also deficient because it does not define a cavity to effectively receive and support partition panels that are to be inserted into the frame component for a partition system.

Due to the deficiencies identified in the partition systems of the prior art and in the methods of assembling the frame assemblies for these conventional partition systems, and also due to the deficiencies identified in frame components that are utilized for alternative purposes, there is a need to provide a method of assembling a frame assembly for a partition system that utilizes a frame component of the frame assembly to effectively receive and support a partition panel for the partition system, and also to automatically and evenly tension a fabric about the partition panel.

SUMMARY OF THE INVENTION AND ADVANTAGES

A method of assembling a frame assembly for a partition system is disclosed. The frame assembly includes at least one partition panel, at least one fabric covering the partition panel, and at least one frame component. The frame component of the frame assembly automatically and evenly tensions the fabric about the partition panel. The terminology tensioning and stretching are used interchangeably throughout.

The method includes the step of providing the at least one frame component. The frame component that is provided according to the subject method includes a support element, a lockable element, and an integral hinge portion defined between the support element and the lockable element. The support element defines at least one cavity for receiving and supporting the partition panel. The lockable element extends from and is moveable relative to the support element.

The method further includes the step of inserting the at least one partition panel and mounting the fabric. More specifically, the at least one partition panel is inserted into the at least one cavity defined by the support element of the frame component, and the fabric is mounted to the lockable element of the frame component.

Once the at least one partition panel is inserted and the fabric is mounted, the method further includes the step of moving the lockable element about the integral hinge portion of the frame component. As such, the fabric that is mounted to the lockable element is automatically and evenly tensioned about the at least one partition panel inserted into the at least one cavity.

Optionally, the method also includes the step of mounting a flexible backing strip to the frame component that spans the support element and the lockable element. The flexible backing strip protects the fabric from the integral hinge portion of the frame component as the lockable element is moved about the integral hinge portion to tension the fabric.

Accordingly, the subject invention provides a method of assembling a frame assembly for a partition system that provides a frame component that is able to effectively receive and support partition panels for the partition system. The frame component that is provided according to this method is also utilized to automatically and evenly tension a fabric about the partition panels. Ultimately, the automatic and even tensioning of the fabric about the partition panels improves the overall appearance of the partition system and avoids unacceptable ripples and sags in the fabric.

BRIEF DESCRIPTION OF THE DRAWINGS

Other advantages of the present invention will be readily appreciated as the same becomes better understood by reference to the following detailed description when considered in connection with the accompanying Figures wherein.

DETAILED DESCRIPTION OF A PREFERRED EMBODIMENT

Figure 1:
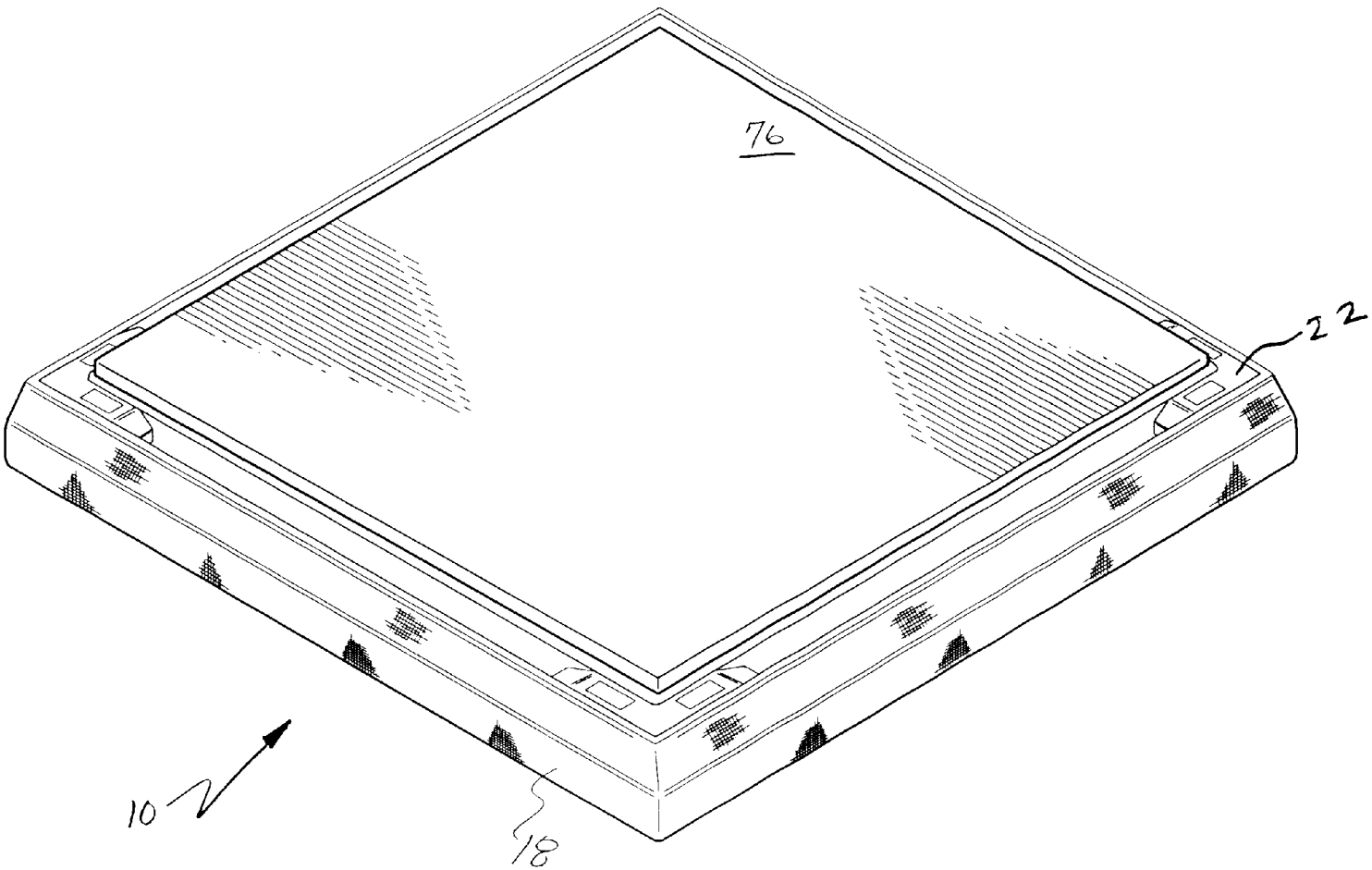
FIG. 1 is a perspective view of a frame assembly illustrating fabric adhered to frame components that are interconnected by corner locks to support a first partition panel.

Referring now to the Figures, wherein like numerals indicate like or corresponding parts throughout the several views, a method of assembling a frame assembly, generally shown at 10 throughout the Figures, is disclosed. The frame assembly 10 in the subject invention is for a partition, or cubicle, system. As is apparent from the Figures and from the description set forth below, the frame assembly 10 is assembled in FIGS. 1, 3, and 4, and unassembled in FIG. 2.

The frame assembly 10 includes at least one partition panel 12. In the preferred embodiment, the frame assembly 10 includes a first partition panel 14 and a second partition panel 16. Accordingly, although the frame assembly 10 may include only one partition panel 12, the subject invention is described below in terms of the first and second partition panels 14, 16.

The partition panels 14, 16 can be manufactured from a wide variety of materials. For example, the partition panels 14, 16 can be manufactured from composite or particulate materials such as fiberglass, from metal, from wood, from foam, and even from laminate materials such as Formica®. Preferably, the first partition panel 14 is a corrugated partition panel manufactured from a low-density fiberglass material. The first partition panel 14 provides cushioning and also acoustical properties, such as sound deadening, to the partition system. Preferably, the second partition panel 16 is manufactured from a high-density fiberglass material. The second partition panel 16 provides 'tackability' to the partition system such that items can be pinned or tacked to the second partition panel 16. Furthermore, although the first and second partition panels 14, 16 are preferably rectangular in shape it is to be understood that the partition panels 14, 16 may be otherwise shaped depending on individual preferences and design considerations.

The frame assembly 10 also includes a fabric 18 that covers the at least one partition panel to enhance the overall appearance of the partition system. Although it is not preferred, the frame assembly 10 may include more than one fabric 18 to cover the at least one partition panel 12. Preferably, there is only one fabric 18 and it is cloth. However, other fabrics including, but not limited to, canvas, burlap, and silk, are also suitable. In the preferred embodiment including the first and second partition panels 14, 16, the fabric 18 covers, the second partition panel 16. To maximize the overall appearance of the partition system, the fabric 18, in the subject invention, is automatically and evenly tensioned about the second partition panel 16 thereby eliminating any ripples or sags in the fabric 18. The automatic and even tensioning of the fabric 18 about the second partition panel 16 is described in greater detail below.

The method includes the step of providing at least one frame component 20 of the frame assembly 10 to appropriately tension the fabric 18 about the second partition panel 16. The frame component 20 automatically and evenly tensions the fabric 18. For descriptive purposes only, the subject invention is described in terms of one frame component 20. However, preferably, a plurality of frame components 20 are provided according to the subject method. It is also preferred that are plurality of corner locks 22 is provided. The corner locks 22 engage the frame components 20 to interconnect the frame components 20 and the corner locks 22 to establish a rectangular-shaped frame assembly 10 where the frame components 20 are interconnected to form a continuous rectangle. As shown in the Figures, each of the corner locks 22 preferably includes first and second arms, not numbered, that extend through a 90° bend. As a result, the corner locks 22 are able to square the frame assembly 10.

Figure 2:
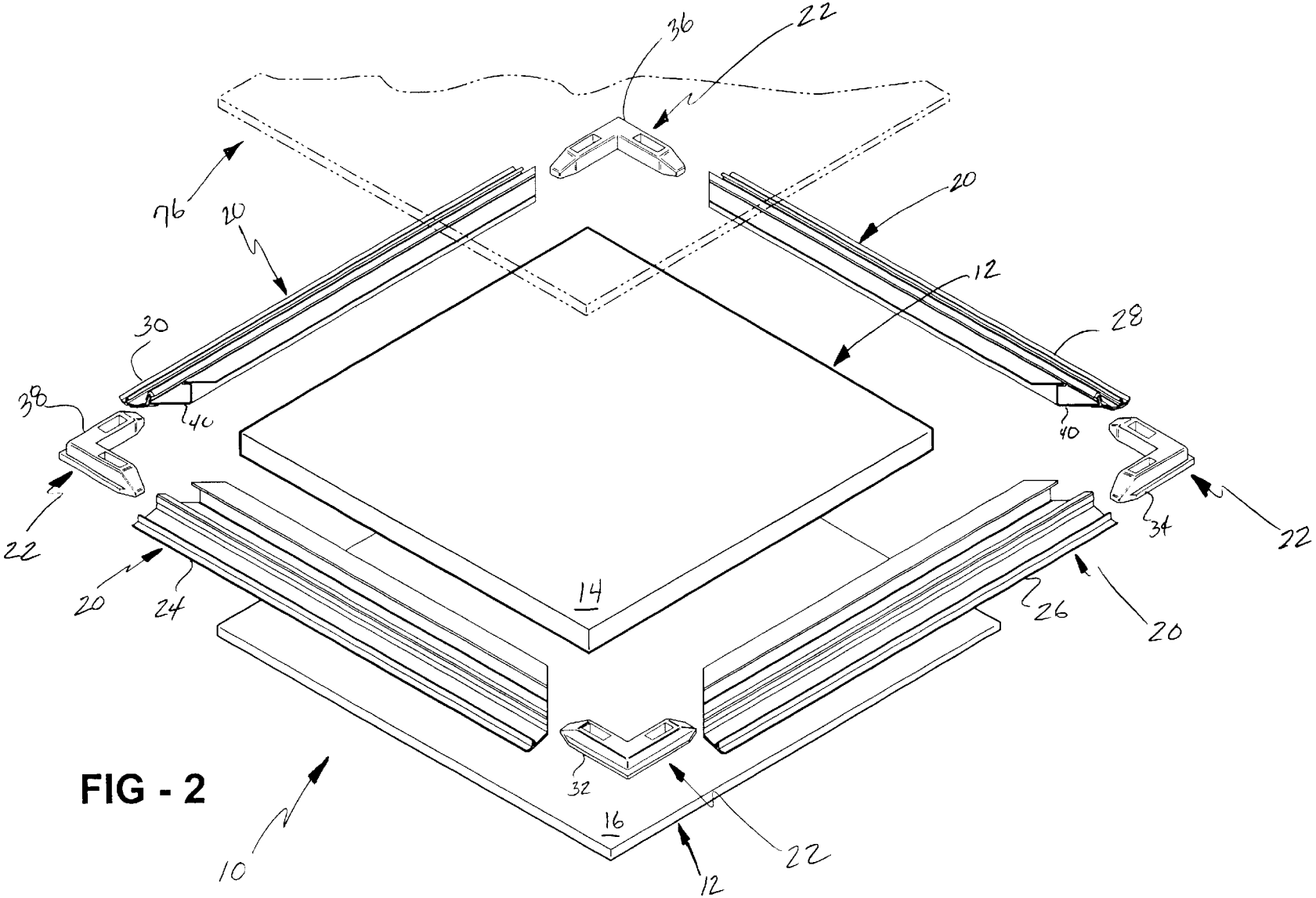
FIG. 2 is an exploded perspective view of the frame assembly disclosed in FIG. 1 illustrating the first partition panel, a second partition panel, and a backing plate.

It is to be understood that the number of frame components 20 and the number of corner locks 22 used in the frame assembly 10 may vary depending on the desired size and shape of the frame assembly 10 and depending also on certain production considerations, such as where the frame component 20 is cut. For example, only one continuous frame component 20, which is rectangular- or box-shaped, may be used in forming the frame assembly 10. As a further example, if the rectangular-shaped frame assembly 10 is desired, and the frame component 20 is L-shaped, then two frame components 20 and two corner locks 22 are used in the rectangular-shaped frame assembly 10. Alternatively, if the rectangular-shaped frame assembly 10 is desired, and the frame component 20 is straight, then four frame components 20 and four corner locks 22, as shown in FIGS. 1 and 2, are used in the rectangular-shaped frame assembly 10. For descriptive purposes, the four frame components 20 that are provided in this method are referred to as first 24, second 26, third 28, and fourth 30 frame components, and the four corner locks 22 that are provided in this method are referred to as first 32, second 34, third 36, and fourth 38 corner locks.

The frame component 20 of the subject invention is formed in a metal forming process. More specifically, to provide the frame component 20, an aluminum or steel sheet, preferably coiled, is roll formed thereby forming the frame component. In the preferred embodiment of the subject invention, the coiled aluminum or steel sheet has a preferred thickness of 0.028 inches, and the frame component 20 is roll formed in a multiple pass process. The coiled sheet is most preferably aluminum, specifically an aluminum alloy, including a particular, predetermined temper. Suitable aluminum alloys include, but are not limited to, Aluminum Association Alloy Nos. 3105, 3003, and 5052, which are known in the art. The coiled sheet is preferably pre-treated to eliminate any potential contaminants, such as greases, processing oils, and the like, and to enhance certain physical properties as needed. If the coiled sheet is the aluminum alloy, then it is preferably pre-treated with a zinc-based pre-treat composition. On the other hand, if the coiled sheet is steel, then it is preferably pre-treated with a phosphate-based pre-treat composition. It is to be understood that the particular material used as the coiled sheet to form the frame component 20 may exceed the scope of the aluminum alloys listed above without varying the scope of the invention as claimed. Additionally, the temper of the material that is selected to from the frame component 20 may vary depending on the particular tensile and yield strengths desired.

Figure 3:
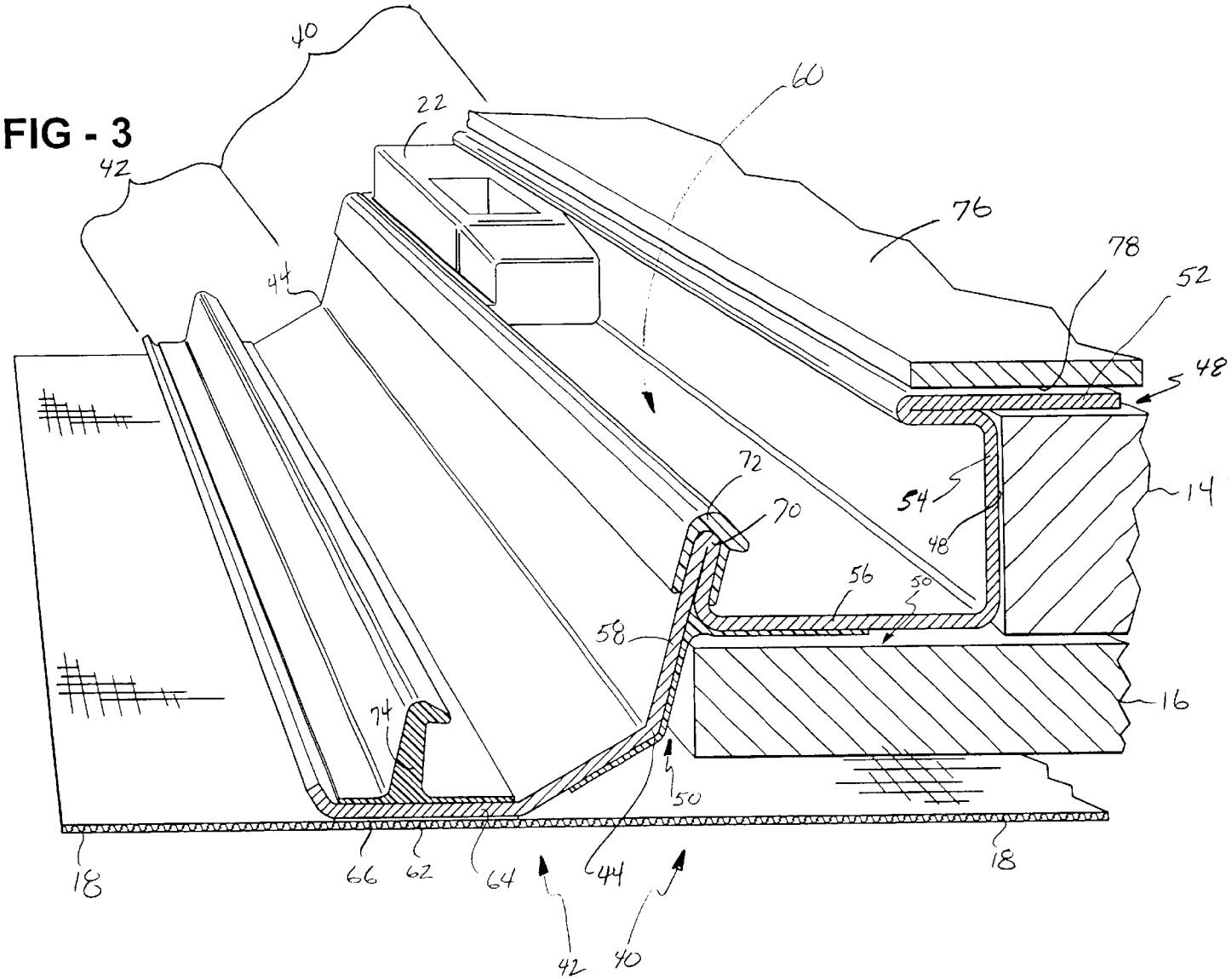
FIG. 3 is a partially cross-sectional perspective view of a frame component including a support element and a lockable element where the frame component is in a relaxed configuration and the first and second partition panels are supported in slots of the frame component.
Figure 4:
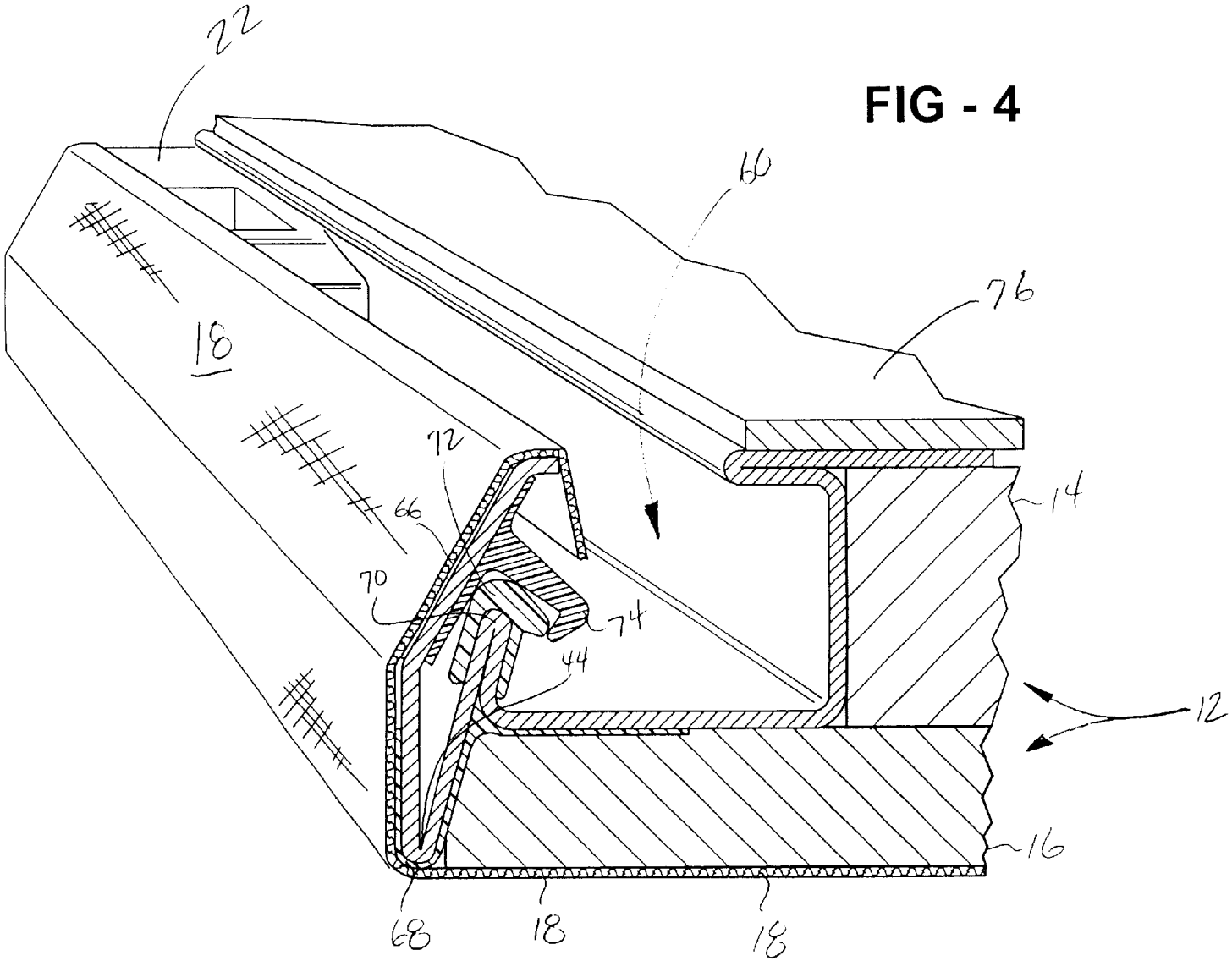
FIG. 4 is a partially cross-sectional perspective view of the frame component disclosed in FIG. 3 in a tensioned configuration where the lockable element has been moved relative to the support element to tension the fabric about the second partition panel.

Referring primarily to FIGS. 3 and 4, the frame component 20 includes a support element 40, a lockable element 42, and an integral hinge portion 44. The frame component 20 that is provided according to the method of the subject invention is preferably unitary, i.e., one piece, is preferably unitary, i.e., one piece, between the support element 40, the lockable element 42, and the integral hinge portion 44. That is, the frame component 20 is preferably a unitary frame component. Although possible, it is not preferred that the support element 40, the lockable element 42, and the integral hinge portion 44 are discrete units that are somehow welded or otherwise fastened together. The support element 40 is defined on one side of the integral hinge portion 33, and the lockable element 42 is defined on the opposite side of the integral hinge portion 44.

The support element 40 defines at least one cavity 46. The cavity 46 is appropriately structured to receive and support at least a portion, not numbered, of the partition panel 12. The partition panel 12 is inserted into the cavity 46 defined by the support element 40. The support element 40 more specifically defines a first cavity 48 and a second cavity 50. The first cavity 48 receives and supports at least a portion of the first partition panel 14, and the second cavity 50 receives and supports at least a portion of the second partition panel 16. The first partition panel 14 is inserted into the first cavity 48, and the second partition panel 16 is inserted into the second cavity 50. As disclosed in FIG. 3, the first cavity 48 is 'filled in' with the first partition panel 14 such that there is no space between the first partition panel 14 and the support element 40, and the second cavity 50 is 'filled in' with the second partition panel 16 such that there is no space between the second partition panel 16 and the support element 40.

The support element 40 of the frame component 20 includes a first segment 52 or wall, a second segment 54, a third segment 56, and a fourth segment 58. The second segment 54 extends transversely from the first segment 52 to define the first cavity 48. The first partition panel 14 is conveniently housed in the first cavity 48, formed from the first and second segments 52, 54, for support. The third segment 56 extends transversely from the second segment 54, and the fourth segment 58 extends transversely from the third segment 56 to define the second cavity 50. The second partition panel 16 is conveniently housed in the second cavity 50, formed from the third and fourth segments 56, 58, for support. Also, a rear channel 60 of the support element 40 is defined between the second and third segments 54, 56. This rear channel 60 receives the corner locks 22.

As shown in the Figures, the corner locks 22 that were described above actually engage the frame component 20 at the support element 40. That is, the corner locks 22 engage the support element 40 to interconnect the frame components 20 and establish the rectangular-shaped frame assembly 10. Therefore, in the example set forth above where four straight frame components 20 and four corner locks 22 are used to establish the frame assembly 10, the first corner lock 32 engages the support element 40 of the first and second frame components 24, 26 to interconnect the first corner lock 32 and the first and second frame components 24, 26, the second corner lock 34 engages the support element 40 of the second and third frame components 26, 28, to interconnect the second corner lock 34 and the second and third frame components 26, 28, the third corner lock 36 engages the support element 40 of the third and fourth frame components 28, 30, to interconnect the third corner lock 36 and the third and fourth frame components 28, 30, and the fourth corner lock 38 engages the support element 40 of the fourth and first frame components 30, 24 to interconnect the fourth corner lock 38 and fourth and first frame components 30, 24.

The frame component 20 also includes the lockable element 42. The lockable element 42 extends from the support element 40, specifically from the fourth segment 58 of the support element 40. Also, the lockable element 42 is moveable relative to the support element 40 (refer to the differences between FIGS. 3 and 4). The lockable element 42 can be moved about the integral hinge portion 44 relative to the support element 40 manually, e.g. by hand, or automatically, e.g. by machine. In FIG. 3, the frame component 20 is disclosed in a relaxed configuration where the lockable element 42 has not been moved relative to the support element 40 and, consequently, the fabric 18 is not tensioned about the second partition panel 16. In FIG. 4, the frame component 20 is disclosed in a tensioned configuration where the lockable element 42 has been moved, i.e., folded or bent upwardly, relative to the support element 40 and, consequently, the fabric 18 is tensioned equally about the second partition panel 16. The movement of the lockable element 42 relative to the support element 40 is described in greater detail below.

The lockable element 42 supports at least a portion 62 of the fabric 18. More specifically, the lockable element 42 includes a flat segment 64 to support the portion 62 of the fabric 18. The flat segment 64 maximizes a surface area of the lockable element 42 that is available for suitably supporting the portion 62 of the fabric 18. The fabric 18 is mounted to the lockable element 42. An adhesive 66 is disposed on the lockable element 42. The step of mounting the fabric 18 to the lockable element 42 is further defined as using the adhesive 66 to adhere the portion 62 of the fabric 18 to the lockable element 42 of the frame component 20. This retains the portion 62 of the fabric 18 on the lockable element 42. More specifically, the adhesive 66 is a polyurethane resin that is pre-applied to the flat segment 64 of the lockable element 42 to adhere the fabric 18 to the flat segment 64. The adhesive, preferably the polyurethane resin, may be applied to the flat segment 64 by any suitable application technique including, but not limited to, wiping, rolling, dipping, and spraying.

Figure 5:
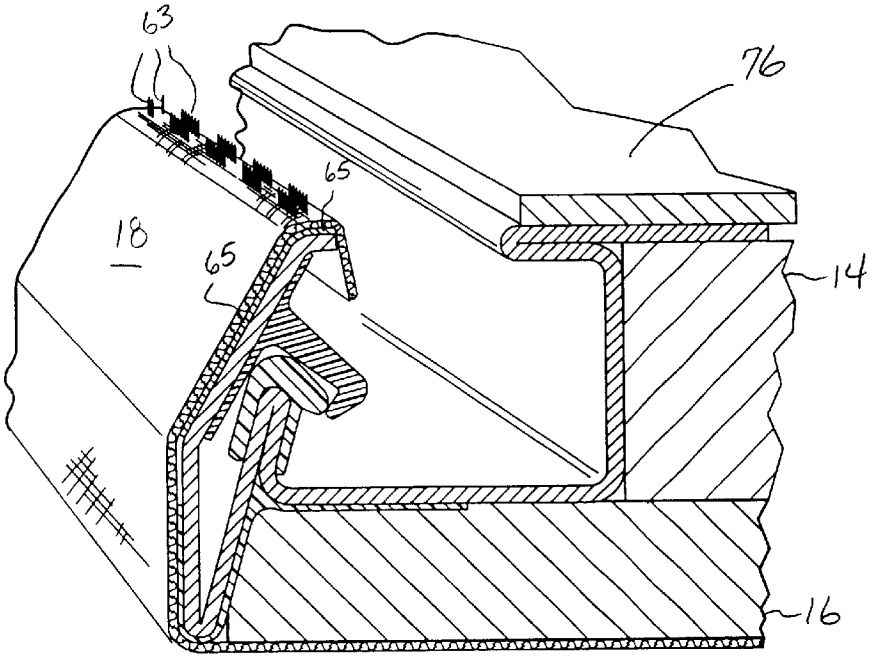
FIG. 5 is a partially cross-sectional perspective view of the frame component illustrating fastening stems that are used to retain the fabric to the lockable element.
Figure 6:
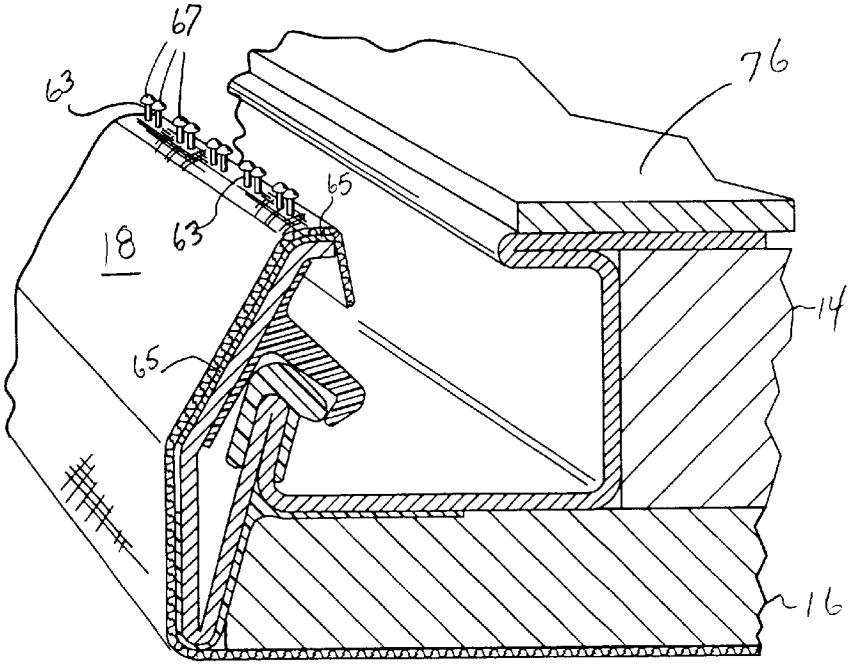
FIG. 6 is a partially cross-sectional perspective view of the frame component illustrating mushroom-type fastening devices that are used to retain the fabric to the lockable element.

Alternatively, as shown in FIGS. 5 and 6, the portion 62 of the fabric 18 may be retained on the lockable element 42 by a plurality of fastening stems 63, instead of the adhesive 66. These fastening stems 63 extend from the lockable element 42 to retain the portion 62 of the fabric. More specifically, in preferred embodiments of the subject invention, the fastening stems 63 extend from a fastener support strip 65. The fastener support strip 65, having the fastening stems 63, may be conventionally mounted, e.g. snap-fit, or extruded onto the frame component 20. The fastening stems 63 extend from the lockable element 42, via the fastener support strip 65, through the fabric 18 to retain the portion 62 of the fabric 18 on the lockable element 42. More specifically, the portion 62 of the fabric 18 is wrapped about the fastening stems 63 such that the stems 63 extend through the fabric 18 to retain the fabric 18 to the lockable element 42 of the frame component 20. It is preferred that the pattern, grain, texture, and/or fibers of the fabric 18 run 180° relative to the fastening stems 63 to encourage optimal retention of the fabric 18 on the lockable element 42. Use of the fastening stems 63 enables the fabric 18 to be replaced, if desired.

Referring specifically to FIG. 6, dome-shaped head portions 67 may be disposed on the fastening stems 63 to retain the portion 62 of the fabric 18 on the lockable element 42. Although not required, it is preferred that there is one dome-shaped head portion 67 disposed on each of the fastening stems 63. The dome-shaped head portions 67 extend through the fabric 18 to encourage optimal retention of the fabric 18 on the lockable element 42. As understood by those skilled in the art, the dome-shaped head portions 67 and the fastening stems 63 are frequently referred to as mushroom-type fastening device.

It is to be understood that the number, size, and orientation of the fastening stems 63, if utilized, and of the dome-shaped head portions 63, if utilized, can vary depending on the type of fabric 18, and other variables. For instance, the fastening stems 63 are shown in two rows in FIG. 5, and it may be determined that more or less rows are required to suitably support and retain the fabric 18 on the lockable element 42.

It is also to be understood that the fabric 18 is preferably mounted to the lockable element 42 after the partition panel 12 has been inserted into the cavity 46. However, it is also within the context of the subject method invention that the fabric 18 be, in some way, adhered to the lockable element 42 before the partition panel 12 has been inserted into the cavity 46. In such an alternative embodiment, the partition panel 12 would then be inserted into cavity 46 after the fabric 18 had been adhered to the lockable element 42.

As set forth above, the frame component 20 also includes the integral hinge portion 44. The integral hinge portion 44 functions as a 'living hinge' defined between the support element 40 and the lockable element 42. In the preferred embodiment, the integral hinge portion 44 is the only bend point for the frame component 20. The integral hinge portion 44 enables the movement of the lockable element 42 relative to the support element 40. The method includes the step of moving the lockable element 42 about the integral hinge portion 44 such that the fabric 18 that is mounted to the lockable element 42 is automatically and evenly tensioned about the partition panel 12 inserted in the cavity 46. More specifically, when the.lockable element 42 of the frame component 20 moves, or is bent, about the integral hinge portion 44 relative to the support element 40, the fabric 18, which is supported on the lockable element 42, is automatically and evenly tensioned about the second partition panel 16. As shown in the Figures, the lockable element 42 of the frame component 20 is bent, or folded, upwardly about the integral hinge portion 44 toward the support element 40 to automatically and evenly tension the fabric 18 about the second partition panel 16. In a sense, the frame component 20 is essentially folded upon itself. In the preferred embodiment, the fabric 18 is automatically and evenly tensioned about the second partition panel 16 that is supported in the second cavity 50.

In the embodiment having the first, second, third, and fourth frame components 24, 26, 28, 30, respectively, interconnected by the four corner locks 22, the lockable element 42 of each of these frame components 24, 26, 28, 30 are all moved relative to the support element 40, at one time, i.e., at the same time. Consequently, the fabric 18 is tensioned evenly, or equally in all directions, between the four frame components 24, 26, 28, 30.

Depending on the material of construction of the frame component 20, the frame component 20, and the pre-treat composition on the frame component 20, may split, crack, or splinter at the integral hinge portion 44 when the lockable element 42 is moved relative to the support element 40, i.e., when the frame component 20 is in the tensioned configuration of FIG. 4. Accordingly, a flexible backing strip 68 is mounted to the frame component 20. The flexible backing strip 68 that is mounted to the frame component 20 spans the support element 40 and the lockable element 42 to protect the fabric 18 from the integral hinge portion 44 as the lockable element 42 is moved about the integral hinge portion 44 to tension the fabric 18 about the second partition panel 16. The flexible backing strip 68 protects the fabric 18 such that the fabric 18 does not rip or tear when the lockable element 42 is moved.

The frame component 20 further includes an engagement lip 70. The engagement lip 70 of the frame component 20 extends integrally from the support element 40 and away from the lockable element 42. The method includes the step of interconnecting the support element 40 and the lockable element 42 to retain the lockable element 42 in the tensioned configuration of FIG. 4 such that the fabric 18 is permanently tensioned about the partition panel 12. More specifically, upon movement of the lockable element 42, the engagement lip 70 engages the lockable element 42 and the support element 40 and the lockable element 42 are interconnected or interlocked to retain, i.e., lock, the lockable element 42 in the tensioned position where the fabric 18 is permanently tensioned about the second partition panel 16. Alternatively, it is to be understood that the engagement lip 70 of the subject invention may extend integrally from the lockable element 42 rather than from the support element 40.

To further improve engagement between the lockable element 42 and the support element 40, the frame component 20 further includes a first locking mechanism 72. The first locking mechanism 72 is disposed on the engagement lip 70 and directly engages the lockable element 42 upon the movement of the lockable element 42 from the relaxed configuration to the tensioned configuration. The frame component 20 may also further include a second locking mechanism 74. The second locking mechanism 74 projects from the lockable element 42 to engage the first locking mechanism 72 disposed on the support element 40. Upon movement of the lockable element 42, the first and second locking mechanisms 72, 74 interlock such that the unitary frame component 20 is self-locking.

The flexible backing strip 68, the first locking mechanism 72, and the second locking mechanism 74 are preferably formed from polyvinyl chloride (PVC) and, for descriptive purposes only, are referred to below as "the PVC components." Furthermore, although the PVC components may be conventionally mounted, e.g. snap fit, onto the frame component 20, the PVC components are preferably extruded onto the frame component 20.

Because the flexible backing strip 68 requires some degree of flexibility to withstand the movement of the lockable element 42 relative to the support element 40 about the integral hinge portion 44 of the frame component 20, it is extruded from a flexible PVC composition. Specifically, the flexible backing strip 68 is extruded onto the frame component 20 to span the support element 40 and the lockable element 42. On the other hand, the first and second locking mechanisms 72, 74 primarily require durability and rigidity. These locking mechanisms 72, 74 require only a minor degree of flexibility such that one of the locking mechanisms 72, 74 can snap, or lock, over the other of the locking mechanisms 72, 74. Accordingly, the first and second locking mechanisms 72, 74 are extruded from a rigid PVC composition that is different from the flexible PVC composition. Also, it is to be understood that certain adhesion promoting coating compositions including, but not limited to acrylic-, polyester-, and polyurethane-based coating compositions may be applied between the frame component 20 and the PVC components prior extrusion to enhance adhesion between the frame component 20 and the PVC components. These adhesion promoting coating compositions form a 'tie layer' between the frame component 20 and the PVC components.

In the preferred embodiment, after the frame component 20 has been roll-formed, the frame component 20 is fed into a first extruder where the rigid PVC composition is introduced. In the first extruder, the first locking mechanism 72 is extruded onto the engagement lip 70 of the support element 40, and the second locking mechanism 74 is extruded onto the lockable element 42. Subsequently, the frame component 20, having the first and second locking mechanisms 72, 74, is fed into a second extruder where the flexible PVC composition is introduced. In the second extruder, the flexible backing strip 68 is extruded onto the frame component 20 to span the support element 40 and the lockable element 42. Other steps typically associated with extrusion processes including, but not limited to, trimming, sizing, cooling, and cutting, may be relied upon to form the flexible backing strip 68 and the first and second locking mechanisms 72, 74.

To reinforce the partition panel 12, in particular the first partition panel 14, and also to provide overall rigidity to the frame assembly 10, the frame assembly 10 further includes a backing plate 76. The backing plate 76 is mounted to the support element 40 of each frame component 20 to reinforce the partition panel 12 and to provide rigidity to the frame assembly 10. More specifically, the backing plate 76 is mounted to a backing surface 78 of the first segment 52 of each support element 40. An adhesive, not shown in the Figures, preferably a polyurethane-based adhesive, is applied to the backing surface 78 of the first segment 52 for adhering the backing plate 76 to the support element 40 of each frame component 20.

The backing plate 76 spans across the partition panel 12 to reinforce the partition panel 12. To appropriately reinforce the partition panel 12, the backing plate 76 only has to span across a portion of the partition panel 12. Preferably though, the backing plate 76 spans across the entire partition panel 12. Because the backing plate 76 spans across the partition panel 12 and because the backing plate 76 is mounted or otherwise connected to the support element 40 of each frame component 20 or components 20, the backing plate 76 also serves to improve the overall rigidity in the frame assembly 10.

The invention has been described in an illustrative manner, and it is to be understood that the terminology that has been used is intended to be in the nature of words of description rather than of limitation. Obviously, many modifications and variations of the present invention are possible in light of the above teachings. Therefore, it is to be understood that within the scope of the appended claims, the invention may be practiced otherwise than as specifically described.

What is claimed is:

1. A method of assembling a frame assembly for a partition system wherein the frame assembly of the partition system includes at least one partition panel, at least one fabric covering the partition panel, and at least one frame component that automatically and evenly tensions the fabric about the partition panel, said method comprising the steps of:

(A) providing the at least one frame component wherein the frame component includes a support element defining at least one cavity for receiving and supporting the partition panel, a lockable element extending from and being moveable relative to the support element, and an integral hinge portion defined between the support element and the lockable element;

(B) inserting the at least one partition panel into the at least one cavity defined by the support element of the frame component;

(C) mounting the fabric to the lockable element of the frame component; and (D) moving the lockable element about the integral hinge portion such that the fabric mounted to the lockable element is automatically and evenly tensioned about the at least one partition panel inserted into the at least one cavity.

2. A method as set forth in claim 1 further comprising the step of interconnecting the support element and the lockable element to retain the lockable element in a tensioned configuration such that the fabric is permanently tensioned about the at least one partition panel.

3. A method as set forth in claim 1 further comprising the step of mounting a backing plate to the support element of the frame component to reinforce the at least one partition panel and to provide rigidity to the frame assembly.

4. A method as set forth in claim 1 wherein the step of (A) providing the at least one frame component comprises the step of roll forming an aluminum or steel sheet to form the at least one frame component.

5. A method as set forth in claim 1 wherein the step of (B) inserting the at least one partition panel into the at least one cavity is further defined as inserting a first partition panel into a first cavity defined by the support element and inserting a second partition panel into a second cavity defined by the support element.

6. A method as set forth in claim 1 wherein the step of (C) mounting the fabric to the lockable element is further defined as adhering a portion of the fabric to the lockable element of the frame component.

7. A method as set forth in claim 1 wherein the step of (C) mounting the fabric to the lockable element is further defined as wrapping a portion of the fabric about a plurality of fastening stems such that the fastening stems extend through the fabric to retain the fabric to the lockable element of the frame component.

8. A method as set forth in claim 1 wherein the step of (D) moving the lockable element about the integral hinge portion is further defined as bending the lockable element about the integral hinge portion toward the support element such that the fabric is automatically and evenly tensioned.

9. A method as set forth in claim 1 further comprising the step of mounting a flexible backing strip to the frame component that spans the support element and the lockable element to protect the fabric from the integral hinge portion as the lockable element is moved about the integral hinge portion.

10. A method as set forth in claim 9 wherein the step of mounting the flexible backing strip to the frame component is further defined as extruding the flexible backing step onto the frame component to span the support element and the lockable element.

11. A method as set forth in claim 1 wherein the step of (A) providing the at least one frame component is further defined as providing a plurality of frame components.

12. A method as set forth in claim 11 further comprising the step of providing a plurality of corner locks.

13. A method as set forth in claim 12 further comprising the step of interconnecting the frame components and the corner locks to establish a rectangular-shaped frame assembly.

14. A method as set forth in claim 13 further comprising the step of mounting a backing plate to the support element of each of the plurality of frame components to reinforce the at least one partition panel and to provide rigidity to the rectangular-shaped frame assembly.

15. A method as set forth in claim 12 wherein the step of providing a plurality of frame components is further defined as providing first, second, third, and fourth frame components.

16. A method as set forth in claim 15 wherein the step of providing a plurality of corner locks is further defined as providing first, second, third, and fourth corner locks.

17. A method as set forth in claim 16 further comprising the steps of;

interconnecting the first corner lock with the support elements of the first and second frame components, interconnecting the second corner lock with the support elements of the second and third frame components, interconnecting the third corner lock with the support elements of the third and fourth frame components, and interconnecting the fourth corner lock with the support elements of the fourth and first frame components, to establish a rectangular-shaped frame assembly.

18. A method as set forth in claim 17 further comprising the step of mounting a backing plate to the support element of the first, second, third, and fourth frame components to reinforce the at least one partition panel and to provide rigidity to the rectangular-shaped frame assembly.

19. A method as set forth in claim 1 wherein the step of (D) moving the lockable element about the integral hinge portion is further defined as manually moving the lockable element about the integral hinge portion such that the fabric is automatically and evenly tensioned.

20. A method as set forth in claim 1 wherein the step of (D) moving the lockable element about the integral hinge portion is further defined as automatically moving the lockable element about the integral hinge portion such that the fabric is automatically and evenly tensioned.

21. A method as set forth in claim 1 wherein the step of (A) providing the at least one frame component is further defined as providing at least one unitary frame component.

22. A frame assembly assembled according to the method of claim 1.

23. A method of assembling a frame assembly for a partition system wherein the frame assembly of the partition system includes at least one partition panel, at least one fabric covering the partition panel, and at least one frame component that automatically and evenly tensions the fabric about the partition panel, said method comprising the steps of:

(A) providing the at least one frame component wherein the frame component includes a support element adapted to support the partition panel, a lockable element extending from and being moveable relative to the support element, and an integral hinge portion defined between the support element and the lockable element;

(B) mounting a flexible backing strip to the frame component that spans the support element and the lockable element to protect the fabric from the integral hinge portion of the frame component;

(C) inserting the at least one partition panel into the at least one cavity defined by the support element of the frame component;

(D) mounting the fabric to the lockable element of the frame component; and (E) moving the lockable element about the integral hinge portion such that the fabric mounted to the lockable element is automatically and evenly tensioned about the at least one partition panel as the fabric is protected from the integral hinge portion.

24. A method as set forth in claim 23 wherein the step of (B) mounting the flexible backing strip to the frame component is further defined as extruding the flexible backing step onto the frame component to span the support element and the lockable element.

25. A method as set forth in claim 23 further comprising the step of interconnecting the support element and the lockable element to retain the lockable element in a tensioned configuration such that the fabric is permanently tensioned about the at least one partition panel.

26. A method as set forth in claim 23 wherein the step of (C) mounting the fabric to the lockable element is further defined as adhering a portion of the fabric to the lockable element of the frame component.

27. A method as set forth in claim 23 wherein the step of (C) mounting the fabric to the lockable element is further defined as wrapping a portion of the fabric about a plurality of fastening stems such that the fastening stems extend through the fabric to retain the fabric to the lockable element of the frame component.

* * * * *